US005382868A

United States Patent [19]

Fukaishi

[11] Patent Number: 5,382,868

[45] Date of Patent: * Jan. 17, 1995

[54] CATHODE-RAY TUBE HAVING DEGAUSSING COILS WITH FLAT PORTIONS ON AN IMPLOSION-RESISTANT BAND

[75] Inventor: Akira Fukaishi, Kanagawa, Japan

[73] Assignee: Sony Corporation, Tokyo, Japan

[ * ] Notice: The portion of the term of this patent subsequent to Aug. 30, 2011 has been disclaimed.

[21] Appl. No.: 925,752

[22] Filed: Aug. 7, 1992

[30] Foreign Application Priority Data

Aug. 7, 1991 [JP] Japan ..... 3-198026

[51] Int. Cl.[6] ..... H01F 13/00

[52] U.S. Cl. ..... 313/313; 315/85; 315/8

[58] Field of Search ..... 313/313, 402, 431, 440; 315/8, 85; 358/245, 246; 361/149, 151, 267, 150

[56] References Cited

U.S. PATENT DOCUMENTS

| | | | |
|---|---|---|---|
| 3,872,347 | 3/1975 | Matsushima et al. | 315/8 |
| 3,879,633 | 4/1975 | Stark, Jr. | 315/8 |
| 4,236,184 | 11/1980 | Palac et al. | 315/8 |
| 4,858,016 | 8/1989 | Suehiro et al. | 358/245 |
| 4,940,920 | 7/1990 | Giannantonio et al. | 313/8 |
| 5,038,078 | 8/1991 | Duggan | 315/8 |
| 5,200,673 | 4/1993 | Hishiki | 315/8 |

FOREIGN PATENT DOCUMENTS

| | | | |
|---|---|---|---|
| 269498 | 6/1988 | European Pat. Off. | H01J 29/00 |
| 1338244 | 11/1970 | Germany | H01F 13/00 |
| 55-111048 | 8/1980 | Japan | H04N 9/29 |
| 2202116 | 9/1988 | United Kingdom | H04N 9/29 |

*Primary Examiner*—Donald J. Yusko
*Assistant Examiner*—Vip Patel
*Attorney, Agent, or Firm*—Jay H. Maioli

[57] ABSTRACT

A cathode-ray tube has a tube body with an implosion-resistant band disposed on the side walls of the tube body. Two degaussing coils are mounted on the implosion-resistant band on opposite walls of the tube body. Each of the degaussing coils is of an annular shape including a flat portion and an extension coupled to opposite ends of the flat portion. The flat portion is attached to the implosion-resistant band by an attachment which has a joint arm fixed to the implosion-resistant band and a holder fitted over the joint arm. The flat portion is resiliently gripped between the joint arm and the holder.

7 Claims, 5 Drawing Sheets

CATHODE-RAY TUBE HAVING DEGAUSSING COILS WITH FLAT PORTIONS ON AN IMPLOSION-RESISTANT BAND

BACKGROUND OF THE INVENTION

1. Field of the Invention

The present invention relates to a cathode-ray tube with an internal magnetic shield disposed in a tube body, the cathode-ray tube having degaussing coils.

2. Description of the Prior Art

Conventional color cathode-ray tubes have a magnetic shield for protecting themselves from stray magnetic fields such as the geomagnetic field, and a degaussing coil for degaussing magnetic parts positioned inside and outside of the cathode-ray tube. Some proposed cathode-ray tubes have an internal magnetic shield positioned within the tube bodies for making the cathode-ray tubes light in weight and allowing the magnetic parts to be degaussed with high efficiency.

FIG. 1 of the accompanying drawings shows one conventional cathode-ray tube with an internal magnetic shield. For sufficiently degaussing the cathode-ray tube, a pair of degaussing coils 22 is located over an implosion-resistant band 21 mounted on the side walls of a tube body 20. Each of the degaussing coils 22 has an outside diameter ranging from 12 to 20 mm. With the degaussing coils 22 of such a dimension being placed on the implosion-resistant band, however, the cathode-ray tube is required to be housed in a relatively large cabinet. In addition, the cabinet is of a poor appearance as its outer frame or bezel is relatively thick.

The degaussing coil 22 for the cathode-ray tube with the internal magnetic shield is attached to the cabinet. However, it is more difficult to attach the degaussing coil 22 to the cabinet than to attach the degaussing coil 22 to the tube body 20.

OBJECTS AND SUMMARY OF THE INVENTION

In view of the aforesaid problems of the conventional cathode-ray tube with an internal magnetic shield, it is an object of the present invention to provide a cathode-ray tube with an internal magnetic shield, which can be housed in a relatively small cabinet and allows degaussing coils to be installed with ease.

According to the present invention, there is provided a cathode-ray tube comprising a tube body with a magnetic shield housed therein, the tube body having side walls, an implosion-resistant band disposed on the side walls of the tube body, and a degaussing coil mounted on the implosion-resistant band, the degaussing coil having a flat portion attached to the implosion-resistant band.

As the flat portion of the degaussing coil is positioned on the implosion-resistant band, the height of the degaussing coil on the implosion-resistant band may De relatively small.

The flat portion is effective to prevent the degaussing oil from being undesirably displaced on the implosion-resistant band. The flat portion also allows the degaussing coil to be fixed directly to the implosion-resistant band by an attachment.

The above and other objects, features, and advantages of the present invention will become apparent from the following description of an illustrative embodiment thereof to be read in conjunction with the accompanying drawings, in which like reference numerals represent the same or similar objects.

DETAILED DESCRIPTION OF THE PREFERRED EMBODIMENT

Figure 1:
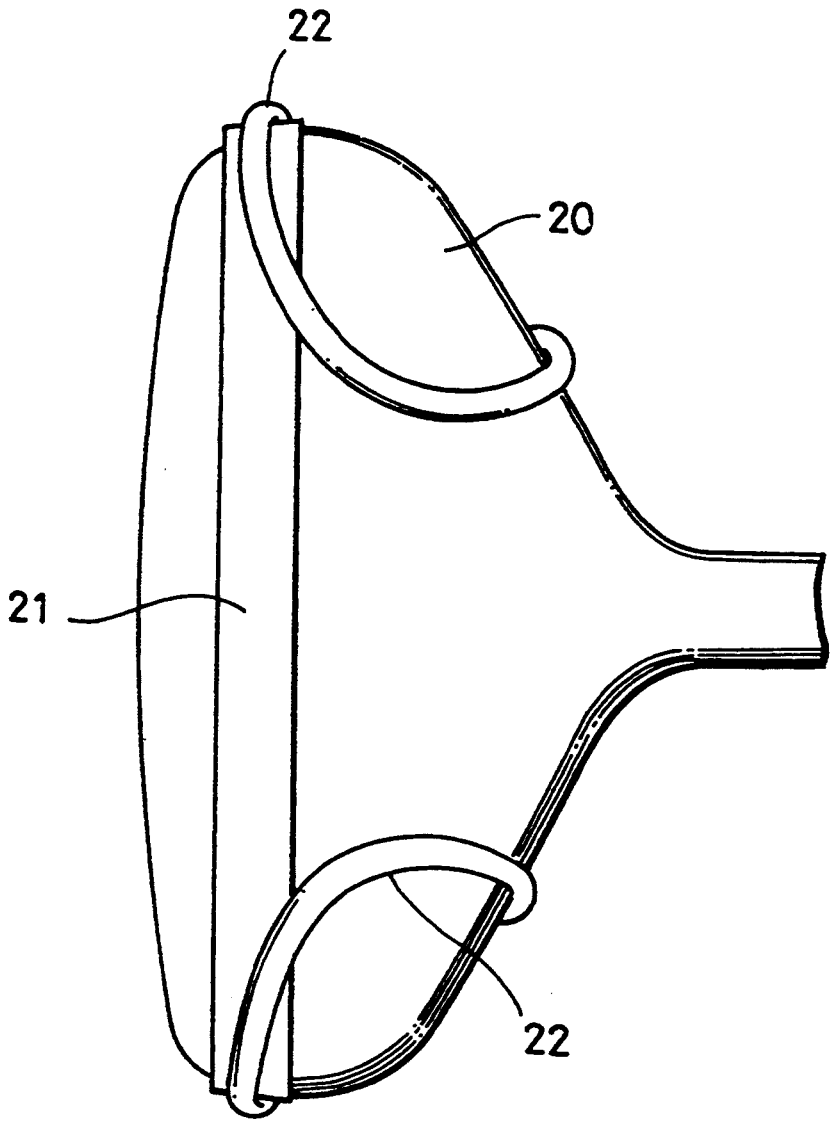
FIG. 1 (PRIOR ART)
FIG. 1 is a side elevational view of a conventional cathode-ray tube.
Figure 2:
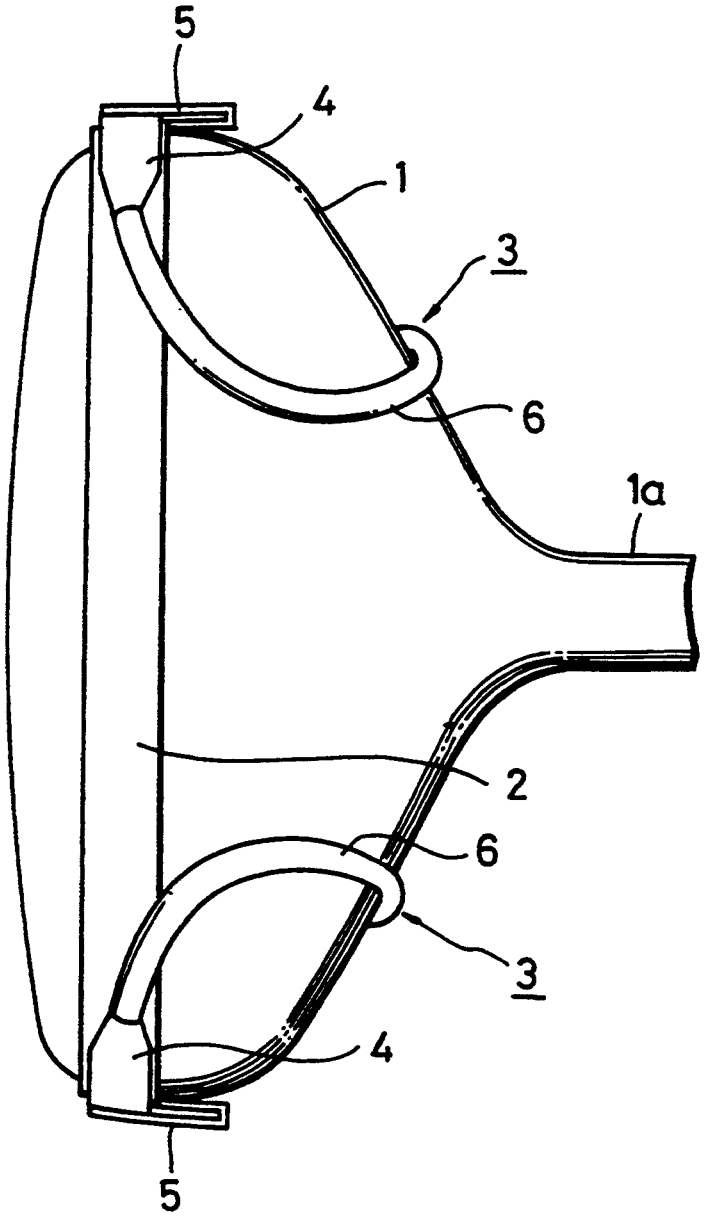
FIG. 2 is a side elevational view of a cathode-ray tube according to the present invention.

FIG. 2 shows a cathode-ray tube according to the present invention.

As shown in FIG. 2, the cathode-ray tube has a tube body 1 housing an internal magnetic shield mounted, for example, on the frame of color selecting electrodes in the tube body 1.

The cathode-ray tube also includes an implosion-resistant band 2 disposed around the side walls of the tube body 1, and a pair of degaussing coils 3 positioned respectively on the upper and lower side walls of the tube body 1 in confronting relationship to each other.

Each of the degaussing coils 3 is of an annular shape and comprises a flat portion 4 of substantially rectangular cross section and an extension 6 of substantially circular cross section which is joined to opposite ends of the flat portion 4. The flat portions 4 of the respective degaussing coils 3 are placed respectively on upper and lower portions of the implosion-resistant band 2, and secured thereto by respective attachments 5. The extensions 6 of the respective degaussing coils 3 extend toward a neck 1*a* of the tube body 1, and are connected to an AC power supply (not shown).

Figure 3:
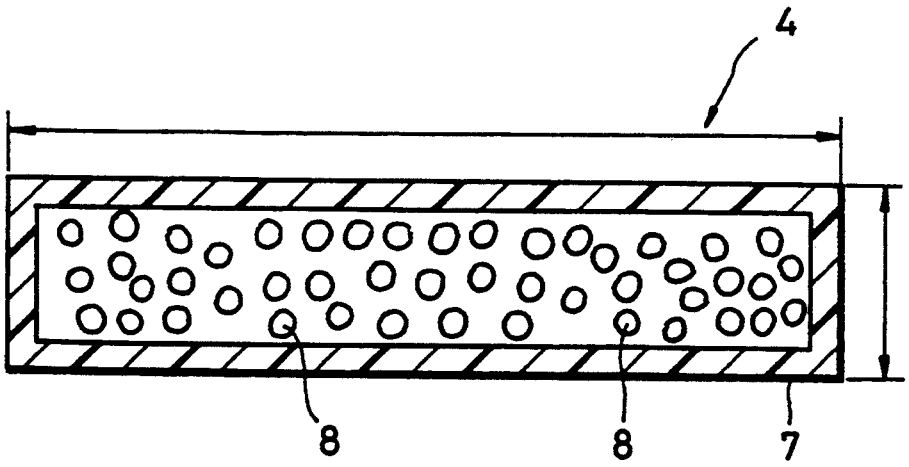
FIG. 3 is an enlarged transverse cross-sectional view of a flat portion of a degaussing coil on the cathode-ray tube.

FIG. 3 shows one of the flat portions 4 of the degaussing coils 3 in cross section.

As shown in FIG. 3, the flat portion 4 comprises a case 7 of rectangular cross section and a plurality of copper wires 8 each coated with an insulative layer which are accommodated in the case 7. If the cathode-ray tube is a 29-inch tube, for example, then the rectangular cross-sectional shape of the case 7 has a width of about 30 mm and a thickness of about 7 mm. The degaussing coil comprises 88 turns of a copper wire, for example, and hence the copper wires 8 in the case 7 are part of those 88 turns of a copper wire.

Figure 4:
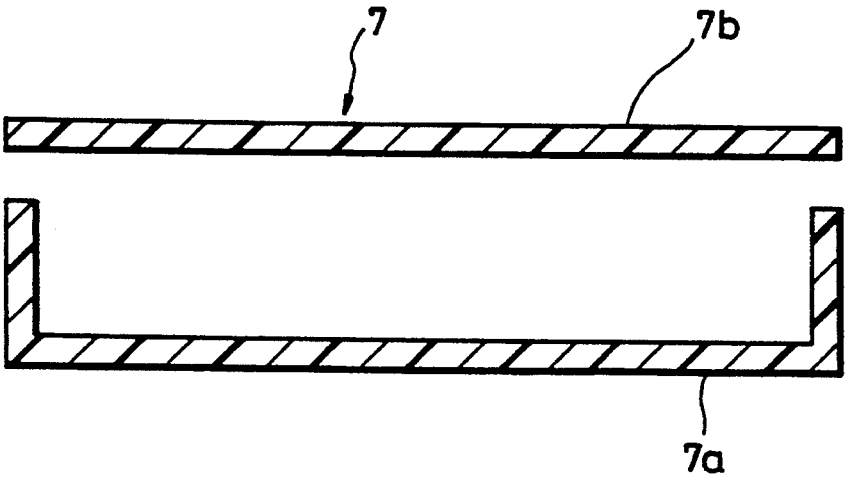
FIG. 4 is an enlarged exploded transverse cross-sectional view of a case of the degaussing coil.

As shown in FIG. 4, the case 7 is made of pliable synthetic resin, and comprises a trough-shaped container 7*a* and a flat cover 7*b* which is to be placed over the container 7*a* with the copper wires 8 accommodated therein.

The flat portion 4 extends along each of the upper and lower walls of the tube body 1, and has a length slightly larger than the horizontal width of the tube body 1 as viewed in front elevation. The flat portion 4 has tapered opposite ends.

Figure 5:
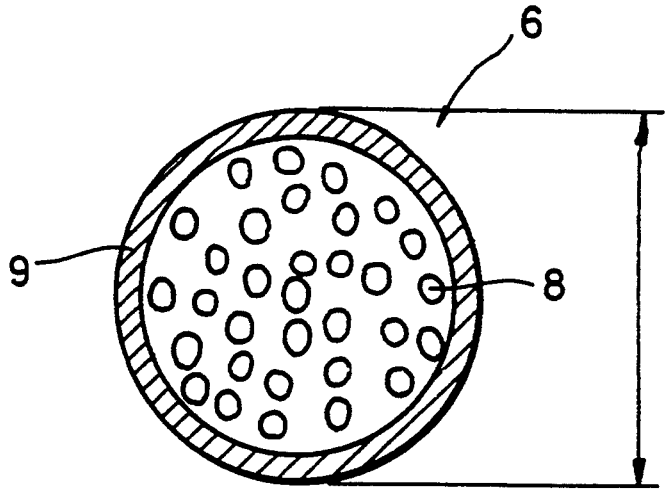
FIG. 5 is an enlarged transverse cross-sectional view of an extension of the degaussing coil.

As shown in FIG. 5, the extension 6 of circular cross section has an outside diameter of about 12 mm. The extension 6 comprises part of the 88 turns of a copper wire which are wrapped by several layers of an insulative tape 9.

Figure 6:
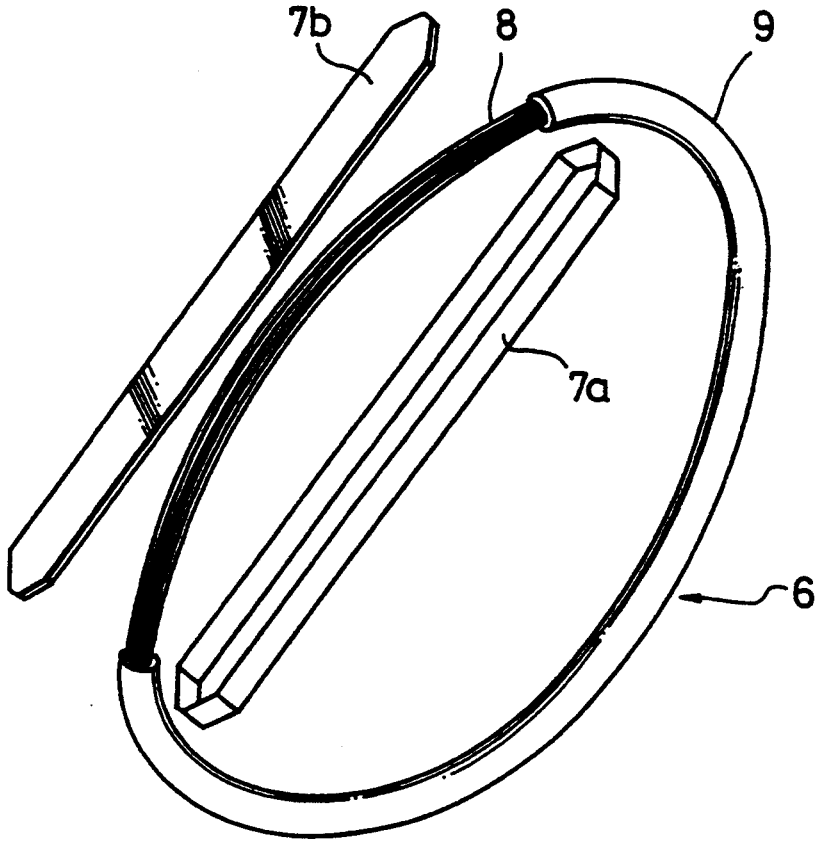
FIG. 6 is a perspective view showing the manner in which the degaussing coil is manufactured.

Each of the degaussing coils 3 may be manufactured as follows:

As shown in FIG. 6, a copper wire 8 is wound into 88 turns, for example, and those turns of the copper wire 8 are wrapped by an insulative tape 9 except for a copper wire region corresponding to the flat portion 4. The exposed copper wires 8 which are not wrapped by the insulative tape 9 are then fitted into the trough-shaped container 7*a* of the case 7, and finally the cover 7*b* is bonded to the container 7*a* by an adhesive, closing the container 7*a*.

Each of the degaussing coils 3 is attached to the tube body 1 by an attachment 5 described below.

Figure 7A:
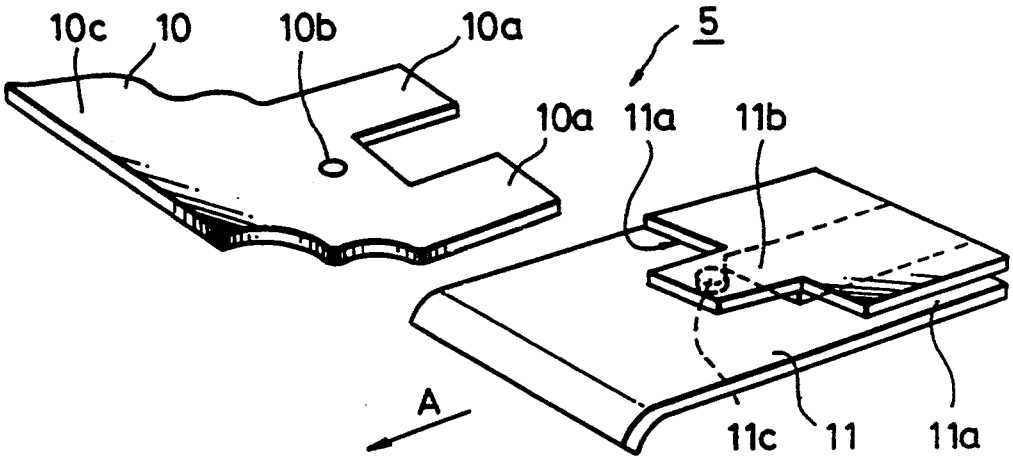
FIG. 7A is an enlarged exploded perspective view of an attachment for the degaussing coil.

As shown in FIG. 7A, the attachment 5 comprises a joint arm 10 and a holder 11, both made of resilient synthetic resin.

The joint arm 10 is in the form of a stepped rectangular thin member having a pair of spaced rectangular tongues 10*a* projecting from one end thereof. The joint arm 10 has a recess 10*b* defined in an upper surface thereof near the cavity defined between the tongues 10*a*.

The holder 11 comprises a rectangular thin member having a thicker end with a pair of grooves 11*a* defined respectively in opposite sides thereof. The grooves 11*a* are shaped to receive the respective tongues 10*a* snugly therein. The holder 11 also has a tongue 11*b* positioned between the grooves 11*a* and projecting toward the opposite end of the holder 11. The tongue 11*b* has a protrusion 11*c* projecting from a surface thereof toward but terminating short of the confronting surface of the holder 11. The protrusion 11*c* is shaped to fit snugly in the recess 11*b* of the joint arm 10.

Figure 7B:
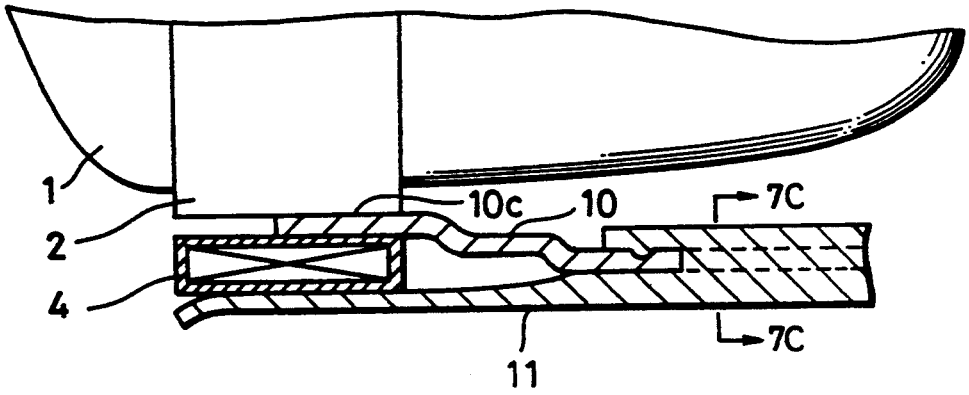
FIG. 7B is an enlarged cross-sectional view of the attachment by which the degaussing coil is attached to an implosion-resistant band on a tube body of the cathode-ray tube.

To install the degaussing coil 3 on the tube body 1, as shown in FIG. 7B, an end 10*c* of the joint arm 10 remote from the tongues 10*a* is fixed to the implosion-resistant band 2 by adhesive bonding, welding, a screw, or the like, and then the flat portion 4 of the degaussing coil 3 is placed on the end 10*c*. Thereafter, the joint arm 10 and the holder 11 are put together.

Figure 7C:
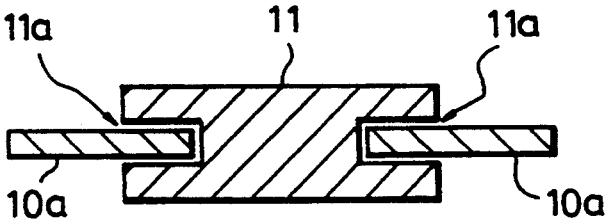
FIG. 7C is a cross-sectional view taken along line 7C—7C of FIG. 7B.

More specifically, as shown in FIG. 7C, the tongues 10*a* of the joint arm 10 are fitted snugly into the respective grooves 11*b* of the holder 11. The holder 11 is moved in the direction indicated by the arrow A in FIG. 7A until the protrusion 11*c* of the holder 11 is snapped into the recess 10*b* of the joint arm 10. The flat portion 4 of the degaussing coil 3 is now gripped resiliently between and held in position by the joint arm 10 and the holder 11.

The attachment 5 shown in FIGS. 7A through 7C is actually positioned on the lower wall of the tube body 1. On the upper wall of the tube body 1, the other degaussing coil 3 is attached to the implosion-resistant band 2 by another attachment 5 with its joint arm 10 and holder 11 positioned upside down.

Each of the degaussing coils 3 may be attached to the implosion-resistant band 2 by a plurality of attachments 5.

Since the flat portion 4 of each of the degaussing coils 3 is placed on the implosion-resistant band 2, the degaussing coils 3 on the implosion-resistant band 2 may be of a relatively small height. Therefore, the outer frame or bezel of a cabinet which houses the cathode-ray tube may be of a relatively low profile. Consequently, the cathode-ray tube according to the present invention may be accommodated in a relatively small cabinet as is the case with cathode-ray tubes with magnetic shields disposed outside of the tube bodies.

The flat portion 4 allows the degaussing coil 3 to be fixed directly to the implosion-resistant band 2, i.e., to be mounted on the tube body 1, simply with the attachment 5 which is of a substantially flat configuration in its entirety. The degaussing coils 3 can thus be installed in position more easily than if they were attached to the cabinet.

The flat portion 4 is also effective to prevent the degaussing coil 3 from being undesirably displaced on the implosion-resistant band 2.

In the illustrated embodiment, only those portions of the degaussing coils 3 which are placed on the implosion-resistant band 2 are flat. However, the degaussing coils 3 may be flat throughout their entire length insofar as their rigidity and shape are adjusted to match the funnel shape of the tube body 1.

The specified dimensions of the flat portions 4 of the degaussing coils 3, the specified dimensions of the degaussing coils 3, and the specified number of turns of the copper wire 8 of the degaussing coils 3 are given by way of example only, and may be varied to suit cathode-ray tubes of various sizes and dimensions.

Having described a preferred embodiment of the invention with reference to the accompanying drawings, it is to be understood that the invention is not limited to that precise embodiment and that various changes and modifications could be effected by one skilled in the art without departing from the spirit or scope of the invention as defined in the appended claims.

What is claimed is:

1. A cathode-ray tube comprising:

a tube body with an internal magnetic shield housed therein, said tube body having side walls, a neck portion, and a tapered transition portion connecting said side walls and said neck portion;

an implosion-resistant band disposed on said side walls of said tube body; and a degaussing coil attached to said implosion-resistant band, said degaussing coil having a flat portion attached to said implosion-resistant band and a tubular portion extending over said tapered transition portion of said tube body.

2. A cathode-ray tube according to claim 1, wherein said degaussing coil is of an annular shape including said flat portion and an extension connected to opposite ends of said flat portion.

3. A cathode-ray tube according to claim 2, wherein said flat portion is of a substantially rectangular cross section and said extension is of a substantially circular cross section.

4. A cathode-ray tube according to claim 3, wherein said flat portion comprises a case formed of pliable synthetic resin and having a substantially rectangular cross section and a plurality of wires accommodated in said case, said wires being part of turns of the degaussing coil.

5. A cathode-ray tube according to claim 1, further including attachment means for attaching said flat portion of said degaussing coil to said implosion-resistant band at said side walls of said tube.

6. A cathode-ray tube comprising:

a tube body with an internal magnetic shield housed therein, said tube body having side walls, a neck portion, and a tapered transition portion connecting said side walls and said neck portion;

an implosion-resistant band disposed on said side walls of said tube body;

a pair of degaussing coils attached to said implosion-resistant band in confronting relationship to each other on opposite ones of said side walls, each of said degaussing coils having a flat portion arranged at said opposite ones of said side walls and a tubular portion extending over said tapered transition portion of said tube body; and a pair of attachments, each being formed of two parts for holding said flat portion therebetween, each of said flat portions being attached to said implosion-resistant band by one of said pair of attachments, respectively.

7. A cathode-ray tube comprising:

a tube body with a magnetic shield housed therein, said tube body having side walls;

an implosion-resistant band disposed on said side walls of the tube body;

a pair of degaussing coils mounted on said implosion-resistant band in confronting relationship to each other on opposite ones of said side walls, each said degaussing coils having a flat portion; and a pair of attachments, said flat portions being attached to said implosion-resistant band by said attachments, respectively.

* * * * *